US008601968B1

(12) United States Patent
Ansel, Jr.

(10) Patent No.: US 8,601,968 B1
(45) Date of Patent: Dec. 10, 2013

(54) BOAT MOORING STANDOFF

(71) Applicant: Irvine Legare Ansel, Jr., Anderson, SC (US)

(72) Inventor: Irvine Legare Ansel, Jr., Anderson, SC (US)

( * ) Notice: Subject to any disclaimer, the term of this patent is extended or adjusted under 35 U.S.C. 154(b) by 0 days.

(21) Appl. No.: 13/672,729

(22) Filed: Nov. 9, 2012

(51) Int. Cl.
*B63B 21/00* (2006.01)

(52) U.S. Cl.
USPC ..... 114/230.15; 114/230.27

(58) Field of Classification Search
USPC ..... 114/221 R, 230.15, 230.2, 230.26, 114/230.27
See application file for complete search history.

(56) References Cited

U.S. PATENT DOCUMENTS 2,924,291 A * 2/1960 Tunstead ..... 182/156
3,151,595 A * 10/1964 Stainbrook ..... 114/230.25
3,406,651 A * 10/1968 Jalbert ..... 114/230.17
5,493,991 A * 2/1996 Wright et al. ..... 114/230.27
5,634,421 A * 6/1997 Velarde ..... 114/230.15
6,123,045 A * 9/2000 Prongay ..... 114/230.15
6,928,945 B1 * 8/2005 Tebo, Jr. ..... 114/230.15
7,789,033 B2 * 9/2010 Doig et al. ..... 114/230.17
8,091,499 B1 * 1/2012 Perez ..... 114/230.15
2009/0025188 A1 * 1/2009 Leyden et al. ..... 24/115 H

* cited by examiner

*Primary Examiner* — Stephen Avila

(57) ABSTRACT

This invention is mounted to a boat instead of a dock and consists of two straight tee fittings and three straight pipes or two straight tee fittings and two straight pipes and a mooring buoy extending from a point between the dock and the side of the boat closest to the dock to a point between the side of the boat closest to the dock and the side of the boat furthest from the dock. A dock mooring rope connected to the first tee fitting extends through the interior channel to a boat mooring cleat located on the side of the boat furthest from the dock. A straight pipe or a mooring buoy mounted vertically secures the device to the boat when the dock mooring rope is secured to a boat mooring cleat located on the side of the boat furthest from the dock. A rope, chain or cable mounted vertically to a dock, pier or piling and passed vertically through the first tee fitting allows the boat to move freely to compensate for movement caused by large waves or tidal changes while holding the boat away from the dock, pier, or piling.

2 Claims, 23 Drawing Sheets

BOAT MOORING STANDOFF

BACKGROUND OF THE INVENTION

This invention pertains to a mooring device and more particularly to a boat mooring device used to secure a boat to a dock, pier, or piling.

There are many devices in use for mooring a boat to a dock to prevent the boat from striking the dock. Generally, these devices are mounted to the dock or mounted between the dock and the boat.

U.S. Pat. No. 6,928,945 to Tebo, Jr. discloses a boat mooring standoff with the first end permanently mounted to the dock and the second end attached with a rope to a dockside mooring cleat on the boat.

U.S. Pat. No. 5,634,421 to Velarde discloses a boat mooring standoff used to attach a boat to a dock or a boat to another boat. The boat mooring standoff is secured by a flexible line that extends through the interior channel of the device. The first end of the flexible line is attached to the dockside mooring cleat on the boat and the second end of the flexible line is attached to the dock.

These devices are designed to utilize the dock to hold the boat in a fixed position away from the dock. These devices have very little flexibility and do not compensate for movement of the boat caused by large waves or tidal changes.

U.S. Pat. No. 7,789,033 to Doig, et al. discloses a boat mooring system with an arm assembly mounted to the dock and extending at a desired angle over the side of the boat. A mooring line is connected from the arm assembly to a dockside mooring cleat on the boat.

This device provides more flexibility to compensate for movement of the boat caused by large waves, but it is mounted on the dock and utilizes the dock to hold the boat in a fixed position away from the dock.

Limitations of prior art which utilize the dock to mount or attach a boat mooring standoff make it desirable to mount a boat mooring standoff on a boat to compensate for movement of the boat caused by large waves or tidal changes and to become a part of the boat instead of a part of the dock or an arm between the dock and the boat. It is also desirable to attach a boat mooring standoff to a boat using the boat mooring cleat on the side of the boat located furthest from the dock instead of attaching the boat mooring standoff to the boat mooring cleat on the side of the boat closest to the dock to provide more flexibility to the boat mooring standoff in order to compensate for movement of the boat caused by large waves and to insure the boat mooring standoff is firmly attached to the boat.

BRIEF SUMMARY OF THE INVENTION

This invention is a boat mooring standoff mounted on a boat instead of a dock which offers greater flexibility to the standoff because the standoff becomes a part of the boat instead of a part of the dock and moves with the boat as the boat is pushed toward the dock by large waves. A first straight tee connected to the first end of the boat mooring standoff permits the standoff to be attached to a rope, chain or cable mounted vertically to a dock, pier or piling. Because the two in line outlets of the first straight tee are installed in a vertical position, this enables the boat mooring standoff to compensate for movement of the boat caused by large waves or tidal changes.

The boat mooring standoff consists of two straight tee fittings and three straight pipes or two straight tee fittings and two straight pipes and a mooring buoy. The looped end of a dock mooring rope is connected to the first straight tee fitting and extended through the interior channel of the boat mooring standoff to a boat mooring cleat located on the side of the boat furthest from the dock. The dock mooring rope pulls the third straight pipe or the mooring buoy against the exterior side of the boat closest to the dock to insure the boat mooring standoff is firmly attached to the boat.

DETAILED DESCRIPTION OF THE INVENTION

Figure 1:
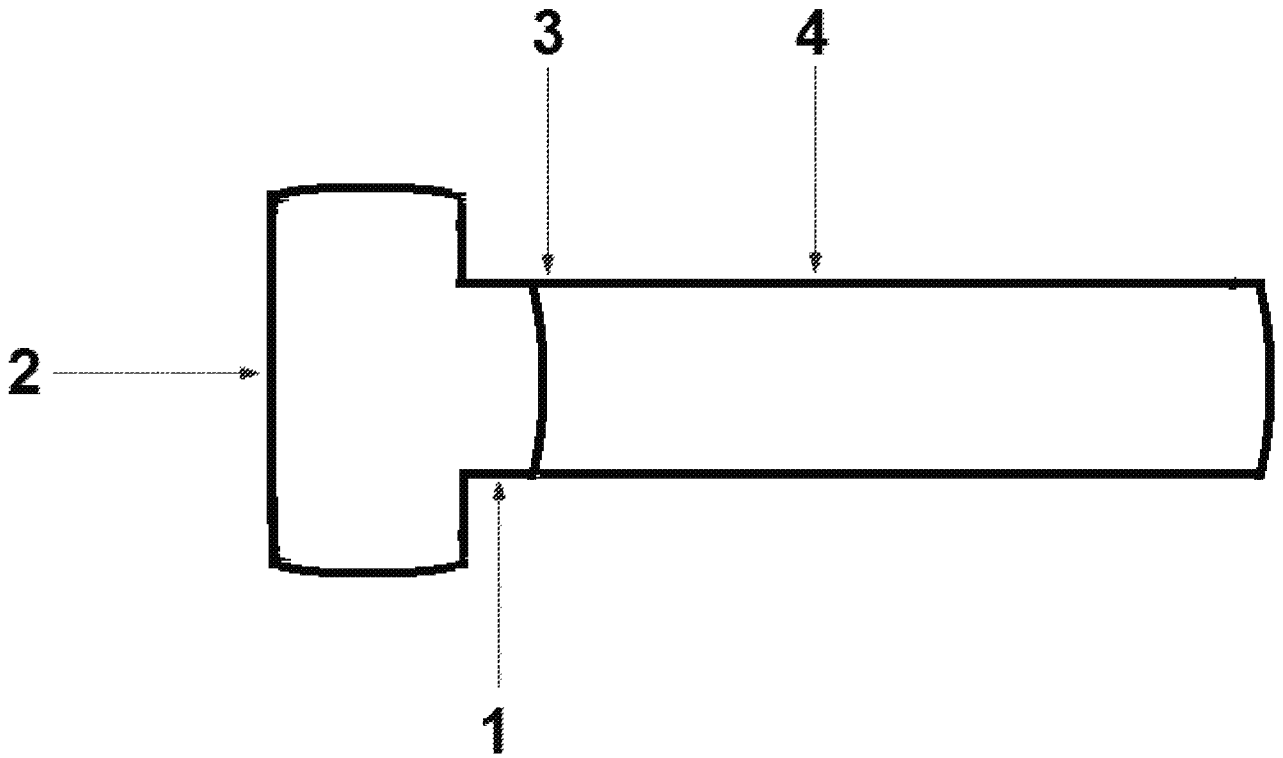
FIG. 1 is an elevation view of the boat mooring standoff during assembly depicting the main branch outlet of the first straight tee connected to the first end of the first straight pipe.

There are two methods to assemble the boat mooring standoff. The first method is to install a third straight pipe to the main branch outlet of the second straight tee to secure the boat mooring standoff to the boat. The second method is to install a mooring buoy to the main branch outlet of the second straight tee to secure the boat mooring standoff to the boat. The choice between using the third straight pipe or the mooring buoy is left to the user. Both methods will secure the boat mooring standoff to the boat.

This invention may be constructed using, PVC, molded composites, or metal. The following is a detailed description of how to assemble the boat mooring standoff using the third straight pipe:

The first step is to connect the first end of the first straight pipe to the main branch outlet of the first straight tee which is perpendicular to the first and second in line outlets of the tee.

The second step is to place the first straight tee and the first straight pipe on a flat surface with the first and second in line outlets and the main branch outlet of the first straight tee and the first straight pipe resting on the flat surface.

The third step is to place the second straight tee on the same flat surface with the first and second in line outlets and the main branch outlet of the second straight tee resting on the flat surface.

The fourth step is to connect the second end of the first straight pipe to the first in line outlet of the second straight tee while keeping all of the parts on the flat surface with the main branch outlet of the second straight tee parallel to the two in line outlets of the first straight tee.

The fifth step is to connect the first end of the second straight pipe to the second in line outlet of the second straight tee.

The sixth step is to connect the first end of the third straight pipe to the main branch outlet of the second straight tee.

The seventh step is to place the boat mooring standoff on a flat surface with the second end of the second straight pipe at the 12 o'clock position and the first and second in line outlets of the first straight tee at the 6 o'clock position and the third straight pipe pointed straight up.

The eighth step is to rotate the boat mooring standoff clockwise until the third straight pipe rests on the flat surface.

The ninth step is to locate a point on the center line of the first straight pipe near the second end of the first straight pipe and near the first in line outlet of the second straight tee.

The tenth step is to drill a hole on the center line of the first straight pipe near the second end of the first straight pipe and near the in line outlet of the second straight tee.

The eleventh step is to place the looped first end of the first dock mooring rope over the main branch outlet of the first straight tee.

The twelfth step is to guide the second end of the first dock mooring rope around the first and second in line outlets of the first straight tee.

The thirteenth step is to guide the second end of the first dock mooring rope between the looped first end of the first dock mooring rope and the main branch outlet of the first straight tee.

The fourteenth step is to insert the second end of the first dock mooring rope into the hole on the center line of the first straight pipe near the first in line outlet of the second straight tee.

The fifteenth step is to guide the second end of the first dock mooring rope through the second end of the first straight pipe and through the first and second in line outlets of the second straight tee and through the first end of the second straight pipe and through the second straight pipe and out of the second end of the second straight pipe.

The sixteenth step is to tug on the second end of the first dock mooring rope tightly to insure the looped first end of the first dock mooring rope is bound tightly around the main branch outlet of the first straight tee.

The following is a detailed description of how to install the boat mooring standoff with the third straight pipe to the stern of a boat.

The first step is to place the boat mooring standoff on the first side of the boat near the first stern mooring cleat with the third straight pipe positioned on the exterior of the first side of the boat and pointed down.

The second step is to place the looped first end of the second dock mooring rope over the second straight pipe near the first end of the second straight pipe.

The third step is to guide the second end of the second dock mooring rope around the first stern mooring cleat and to secure the second dock mooring rope to the cleat. This will restrict the forward and aft movement of the boat when the boat mooring standoff is in use.

The fourth step is to guide the second end of the first dock mooring rope around the second stern mooring cleat located on the second side of the boat opposite the first stern mooring cleat. Pull the first dock mooring rope tightly and secure it to the cleat. This forces the third straight pipe against the exterior of the first side of the boat and secures the boat mooring standoff firmly to the boat.

The following is a detailed description of how to install the boat mooring standoff with the third straight pipe to the bow of a boat.

The first step is to place the boat mooring standoff on the first side of the boat near the first bow mooring cleat with the third straight pipe positioned on the exterior of the first side of the boat and pointed down.

The second step is to guide the second end of the first dock mooring rope around the second bow mooring cleat located on the second side of the boat opposite the first bow mooring cleat. Pull the first dock mooring rope tightly and secure it to the cleat. This forces the third straight pipe against the exterior of the first side of the boat and secures the boat mooring standoff firmly to the boat.

The following is a detailed description of how to assemble the boat mooring standoff using the mooring buoy:

The first step is to connect the first end of the first straight pipe to the main branch outlet of the first straight tee which is perpendicular to the first and second in line outlets of the tee.

The second step is to place the first straight tee and the first straight pipe on a flat surface with the first and second in line outlets and the main branch outlet of the first straight tee and the first straight pipe resting on the flat surface.

The third step is to place the second straight tee on the same flat surface with the first and second in line outlets and the main branch outlet of the second straight tee resting on the flat surface.

The fourth step is to connect the second end of the first straight pipe to the first in line outlet of the second straight tee while keeping all of the parts on the flat surface with the main branch outlet of the second straight tee parallel to the two in line outlets of the first straight tee.

The fifth step is to connect the first end of the second straight pipe to the second in line outlet of the second straight tee.

The sixth step is to place the boat mooring standoff on a flat surface with the second end of the second straight pipe at the 12 o'clock position and the first and second in line outlets of the first straight tee at the 6 o'clock position and the main branch outlet of the second straight tee pointed straight up.

The seventh step is to rotate the boat mooring standoff clockwise until the main branch outlet of the second straight tee rests on the flat surface.

The eighth step is to locate a point on the center line of the first straight pipe near the second end of the first straight pipe and near the first in line outlet of the second straight tee.

The ninth step is to drill a hole on the center line of the first straight pipe near the second end of the first straight pipe and near the in line outlet of the second straight tee.

The tenth step is to place the looped first end of the first dock mooring rope over the main branch outlet of the first straight tee.

The eleventh step is to guide the second end of the first dock mooring rope around the first and second in line outlets of the first straight tee.

The twelfth step is to guide the second end of the first dock mooring rope between the looped first end of the first dock mooring rope and the main branch outlet of the first straight tee.

The thirteenth step is to insert the second end of the first dock mooring rope into the hole on the center line of the first straight pipe near the first in line outlet of the second straight tee.

The fourteenth step is to guide the second end of the first dock mooring rope through the second end of the first straight pipe and through the first in line outlet of the second straight tee and out of the main branch outlet of the second straight tee and through the eye of the mooring buoy.

The fifteenth step is to guide the second end of the first dock mooring rope through the main branch outlet of the second straight tee and through the second in line outlet of the second straight tee and through the first end of the second straight pipe and through the second straight pipe and out of the second end of the second straight pipe.

The sixteenth step is to tug on the second end of the first dock mooring rope tightly to insure the looped first end of the first dock mooring rope is bound tightly around the main branch outlet of the first straight tee.

The following is a detailed description of how to install the boat mooring standoff with the mooring buoy to the stern of a boat:

The first step is to position the boat mooring standoff on the first side of the boat near the first stern mooring cleat with the mooring buoy positioned on the outside of the boat and pointed down.

The second step is to position the looped first end of the second dock mooring rope over the second straight pipe near the first end of the second straight pipe.

The third step is to guide the second end of the second dock mooring rope around the first stern mooring cleat and to secure the second dock mooring rope to the cleat. This will restrict the forward and aft movement of the boat when the boat mooring standoff is in use.

The fourth step is to guide the second end of the first dock mooring rope around the second stern mooring cleat. Pull tightly on the first dock mooring rope and secure it to the cleat. This forces the mooring buoy against the exterior of the first side of the boat and secures the boat mooring standoff firmly to the boat.

The following is a detailed description of how to install the boat mooring standoff with the mooring buoy to the bow of a boat:

The first step is to position the boat mooring standoff on the first side of the boat near the first bow mooring cleat with the mooring buoy positioned on the outside of the boat and pointed down.

The second step is to guide the second end of the first dock mooring rope around the second bow mooring cleat. Pull tightly on the first dock mooring rope and secure it to the cleat.

This forces the mooring buoy against the exterior of the first side of the boat and secures the boat mooring standoff firmly to the boat.

Referring now to the drawings, and particularly to FIG. 1, the main branch outlet 1 of the first straight tee 2 is connected to the first end 3 of the first straight pipe 4.

Figure 2:
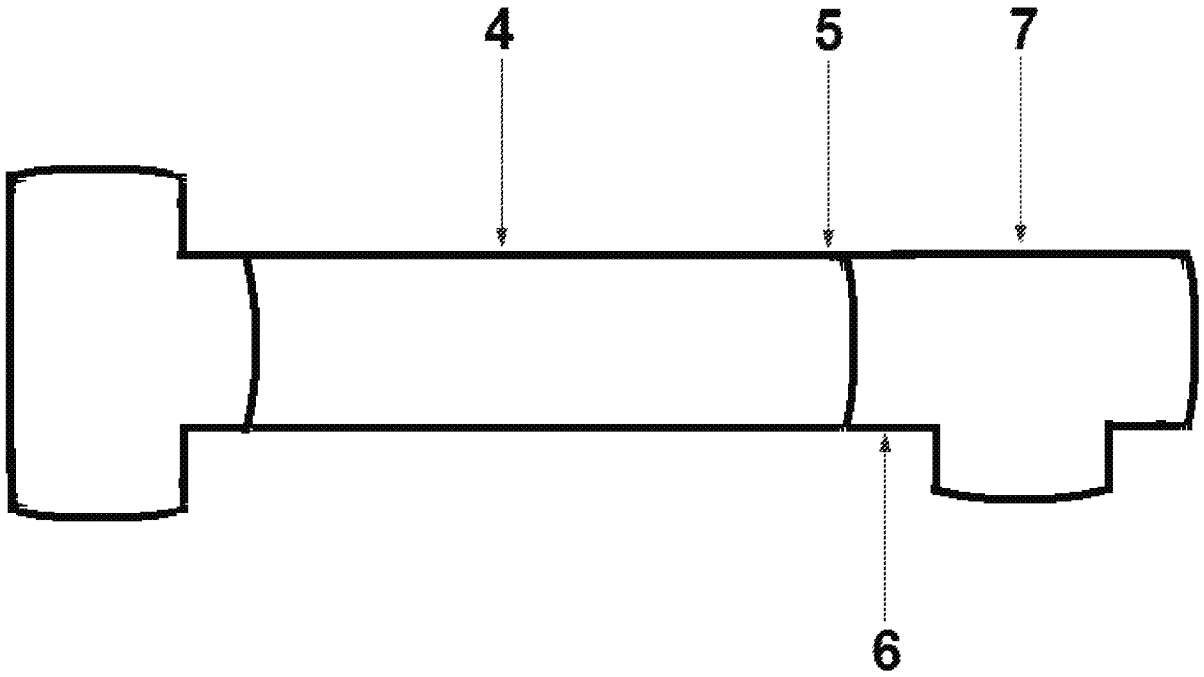
FIG. 2 is an elevation view of the boat mooring standoff during assembly depicting the second end of the first straight pipe connected to the first in line outlet of the second straight tee.

Referring to FIG. 2, the second end 5 of the first straight pipe 4 is connected to the first in line outlet 6 of the second straight tee 7.

Figure 3:
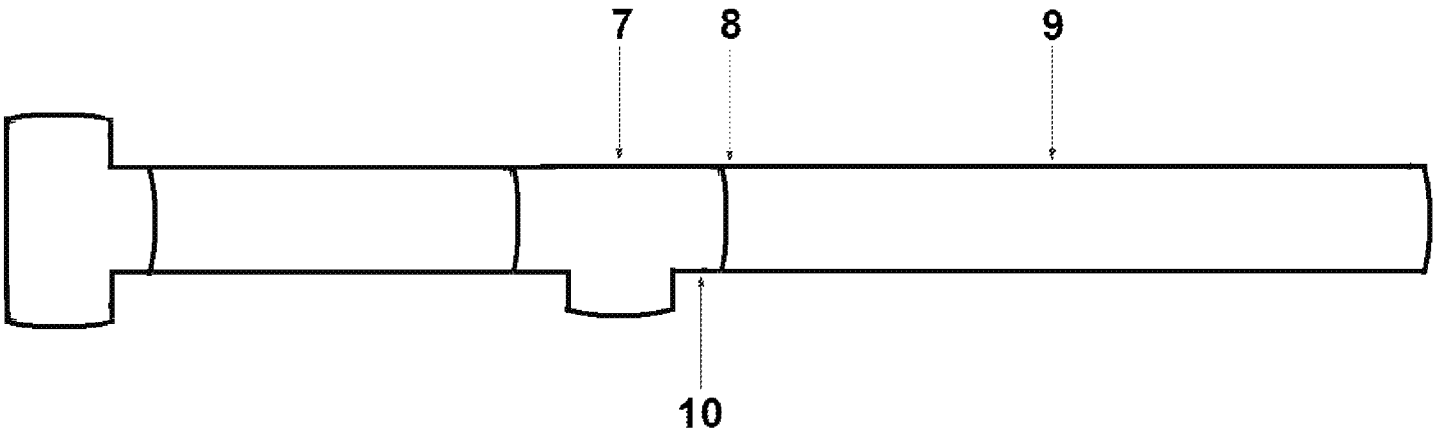
FIG. 3 is an elevation view of the boat mooring standoff during assembly depicting the first end of the second straight pipe connected to the second in line outlet of the second straight tee.

Referring to FIG. 3, the first end 8 of the second straight pipe 9 is connected to the second in line outlet 10 of the second straight tee 7.

Figure 4:
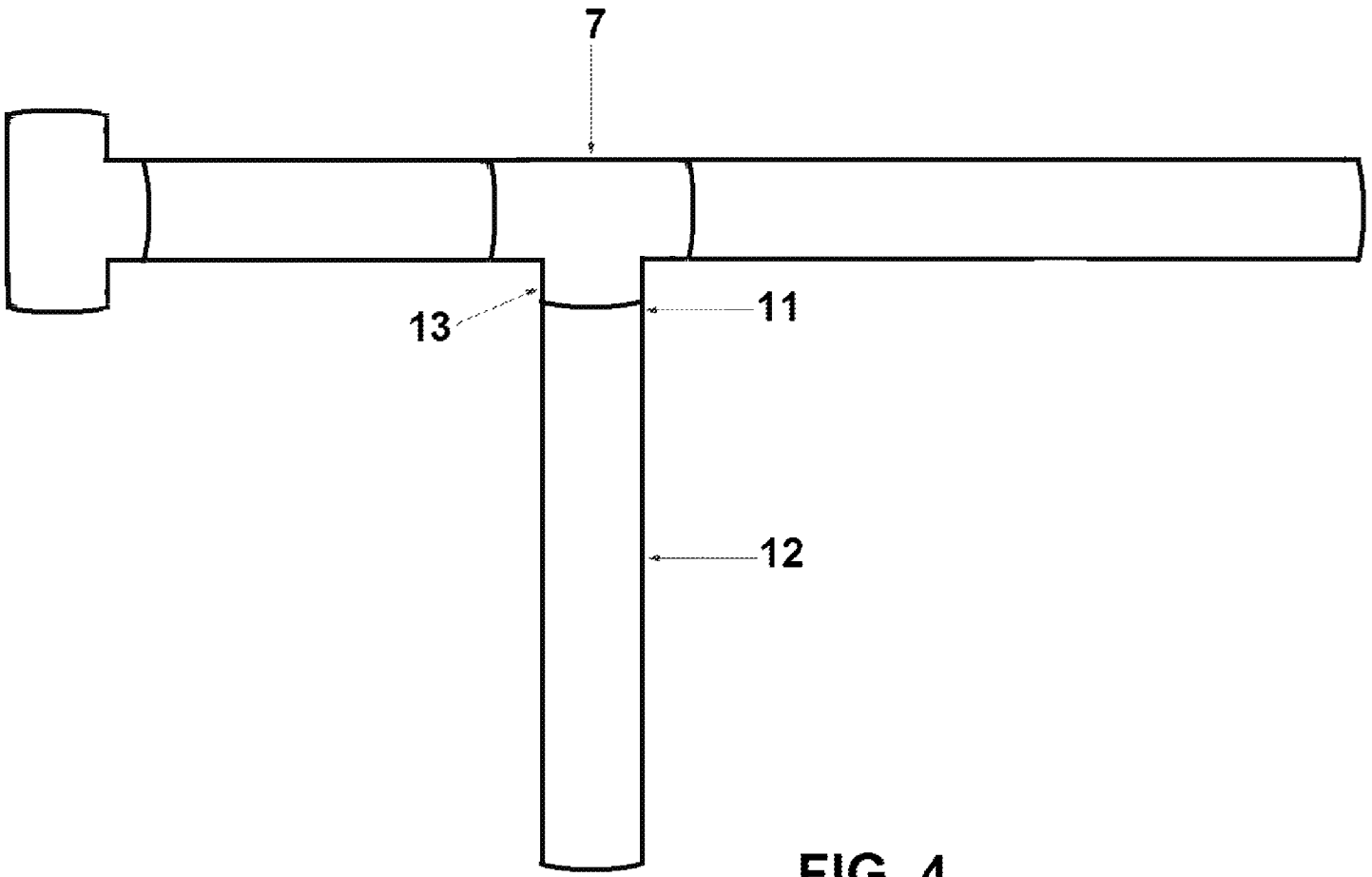
FIG. 4 is an elevation view of the boat mooring standoff during assembly depicting the first end of the third straight pipe connected to the main branch outlet of the second straight tee.

Referring to FIG. 4, the first end 11 of the third straight pipe 12 is connected to the main branch outlet 13 of the second straight tee 7.

Figure 5:
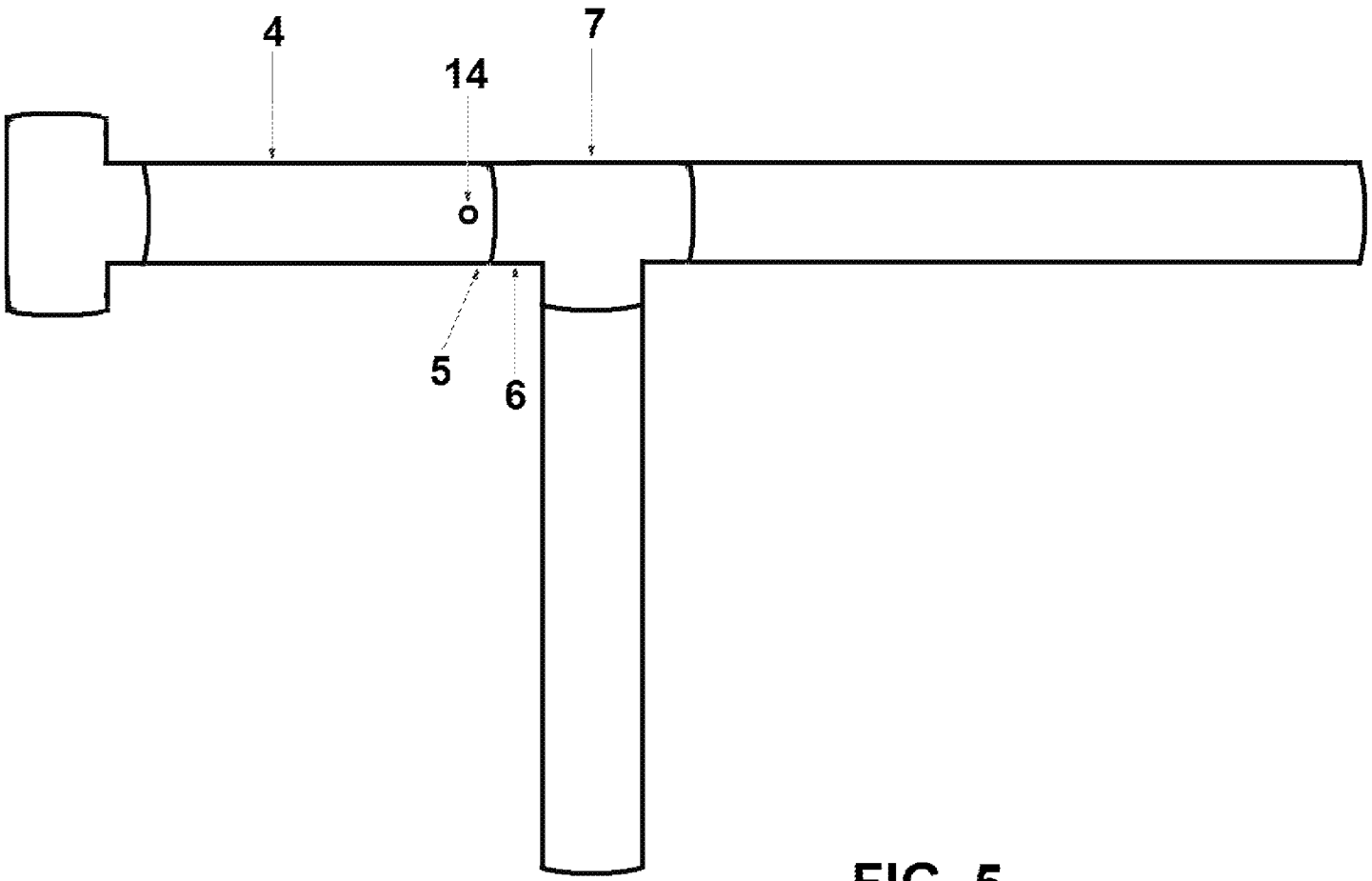
FIG. 5 is an elevation view of the boat mooring standoff during assembly depicting a hole drilled on the center line of the first straight pipe near the second end of the first straight pipe and near the first in line outlet of the second straight tee.

Referring to FIG. 5, a hole 14 is drilled on the center line of the first straight pipe 4 near the second end 5 of the first straight pipe 4 near the first in line outlet 6 of the second straight tee 7.

Figure 6:
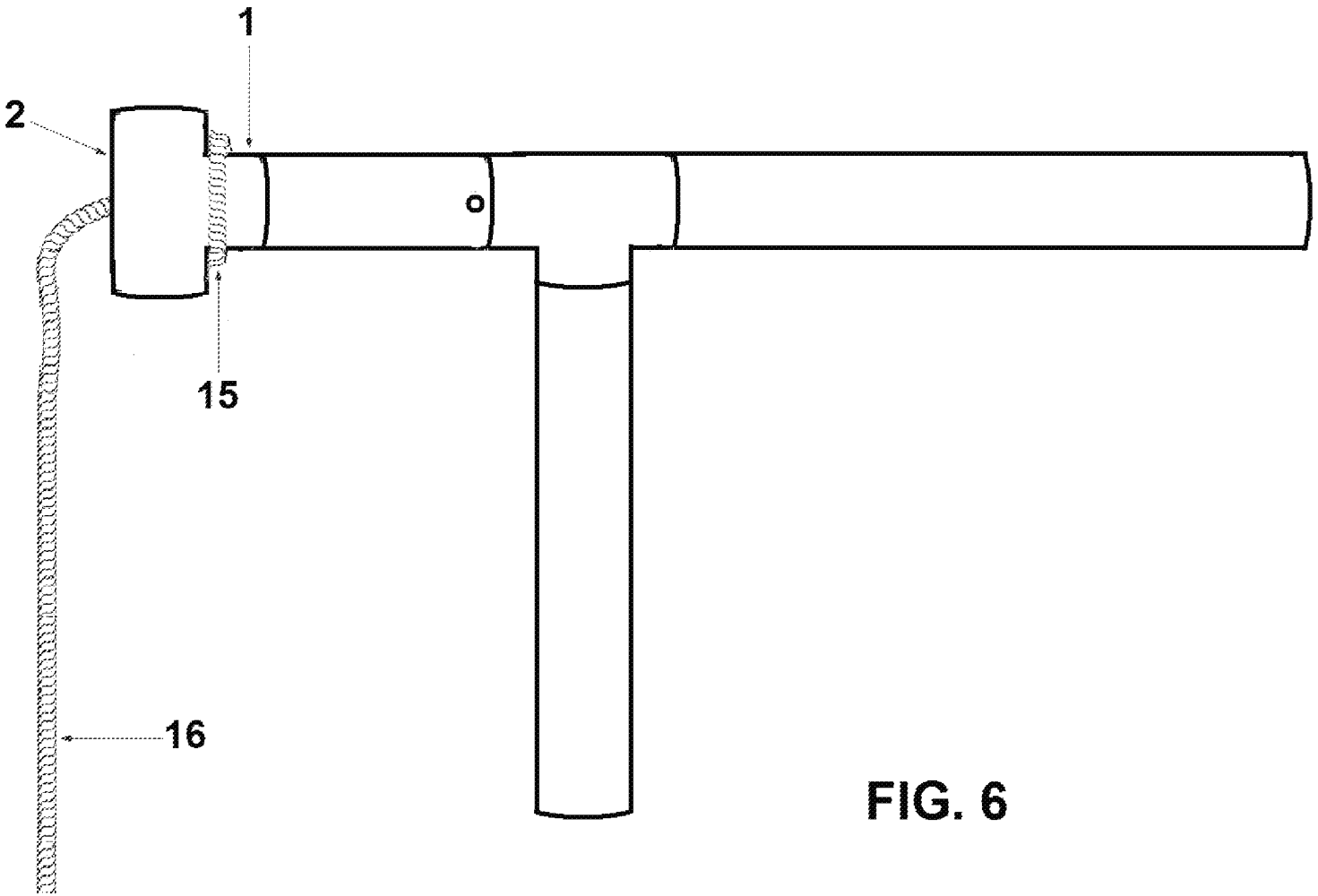
FIG. 6 is an elevation view of the boat mooring standoff during assembly depicting the looped first end of the first dock mooring rope placed over the main branch outlet of the first straight tee.

Referring to FIG. 6, the looped first end 15 of the first dock mooring rope 16 is placed around the main branch outlet 1 of the first straight tee 2.

Figure 7:
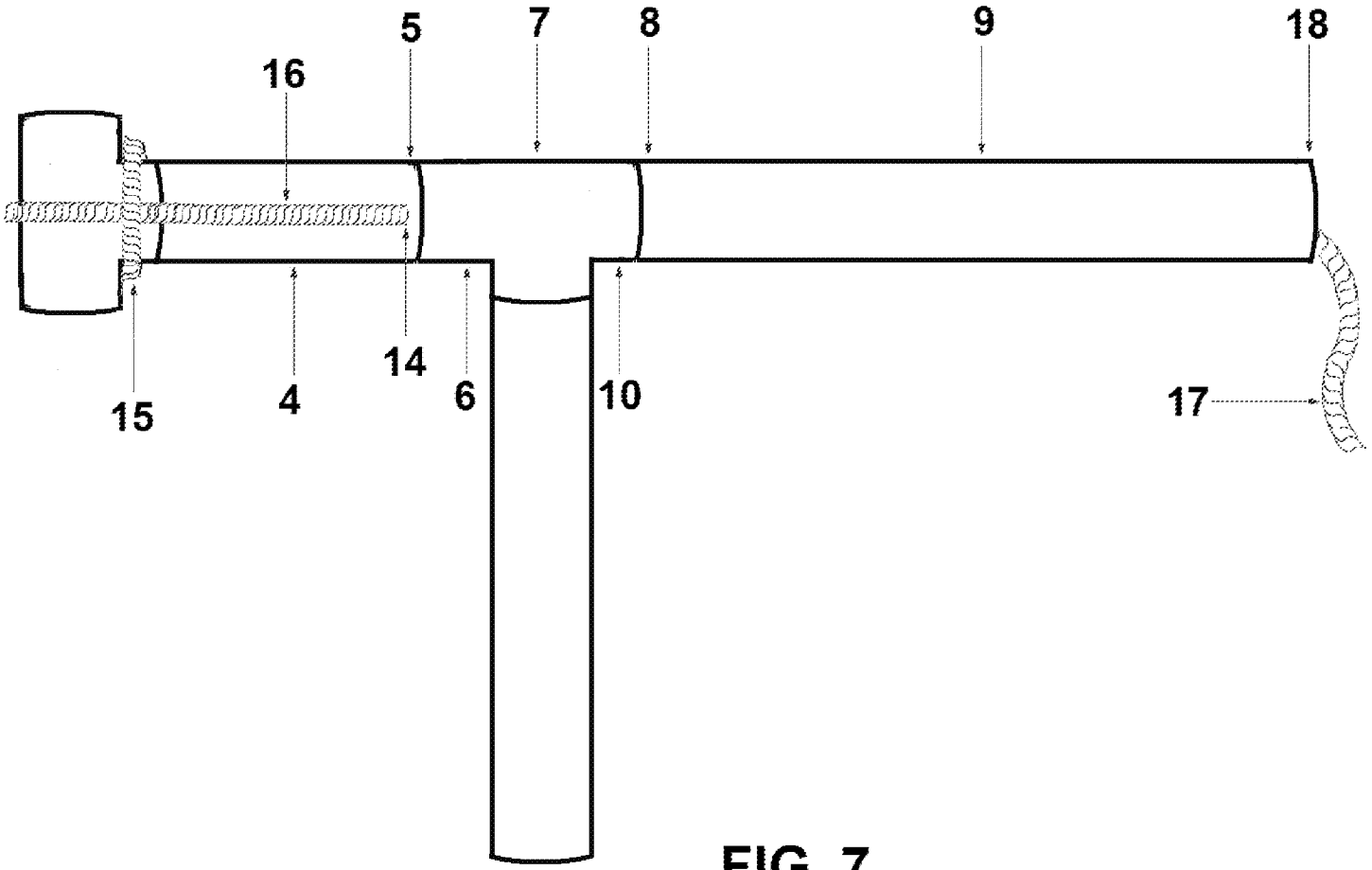
FIG. 7 is an elevation view of the boat mooring standoff during assembly depicting the second end of the first dock mooring rope routed under the looped first end of the first dock mooring rope and through the hole on the center line of the first straight pipe and through the second end of the first straight pipe and through the first and second in line outlets of the second straight tee and through the first end of the second straight pipe and through the second straight pipe and out of the second end of the second straight pipe.

Referring to FIG. 7, the second end 17 of the first dock mooring rope 16 is routed under the looped first end 15 of the first dock mooring rope 16 and through hole 14 on the center line of the first straight pipe 4. The second end 17 of the first dock mooring rope 16 extends through the second end 5 of the first straight pipe 4 and through the first in line outlet 6 and the second in line outlet 10 of the second straight tee 7 and through the first end 8 of the second straight pipe 9 and through the second straight pipe 9 and out of the second end 18 of the second straight pipe 9.

Figure 8:
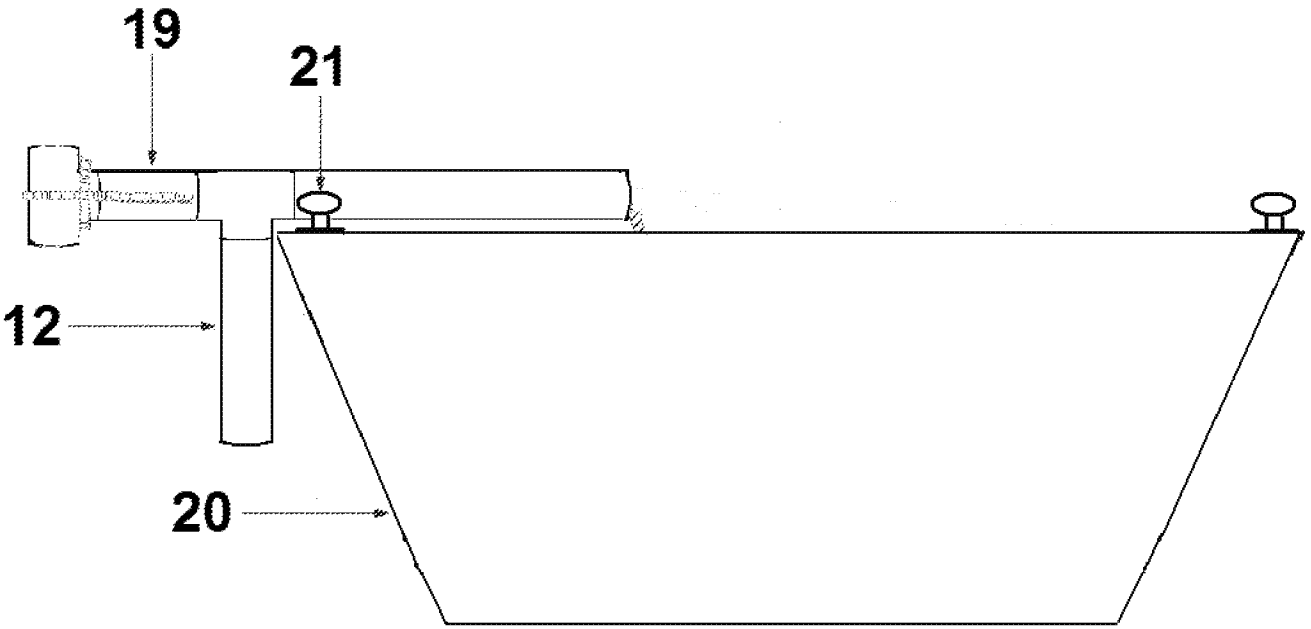
FIG. 8 is an elevation view of the boat mooring standoff during installation depicting the boat mooring standoff placed on the first side of the boat near the first stern mooring cleat with the third straight pipe positioned on the exterior of the first side of the boat and pointed down.

Referring to FIG. 8, the boat mooring standoff 19 is positioned on the first side 20 near the first stern mooring cleat 21 with the third straight pipe 12 on the exterior of the first side 20 and pointed down.

Figure 9:
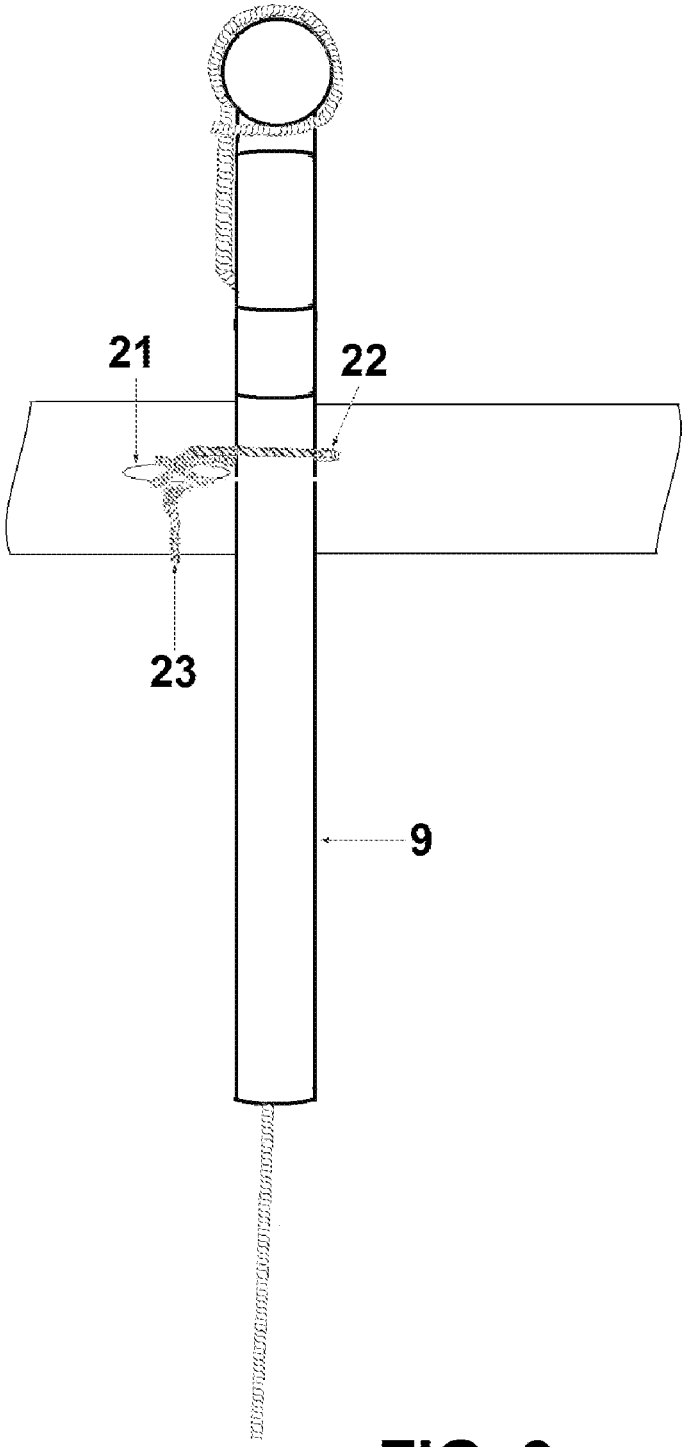
FIG. 9 is a plan view of the boat mooring standoff during installation depicting the looped first end of the second dock mooring rope placed over the second straight pipe and attached to the first stern mooring cleat.

Referring to FIG. 9, the looped first end 22 of the second dock mooring rope 23 is positioned around the second straight pipe 9 and secured to the first stern mooring cleat 21.

Figure 10:
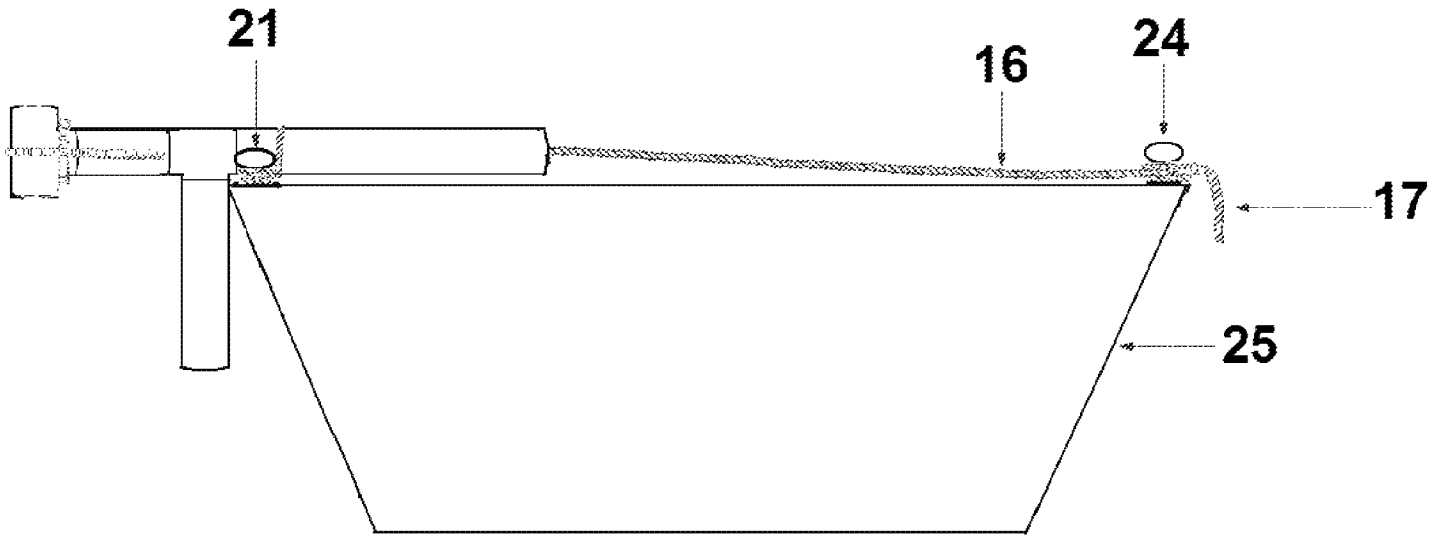
FIG. 10 is an elevation view of the boat mooring standoff during installation depicting the second end of the first dock mooring rope routed around the second stern mooring cleat located on the second side of the boat opposite the first stern mooring cleat.

Referring to FIG. 10, the second end 17 of the first dock mooring rope 16 is secured to the second stern mooring cleat 24 located on the second side 25 opposite the first stern mooring cleat 21.

Figure 11:
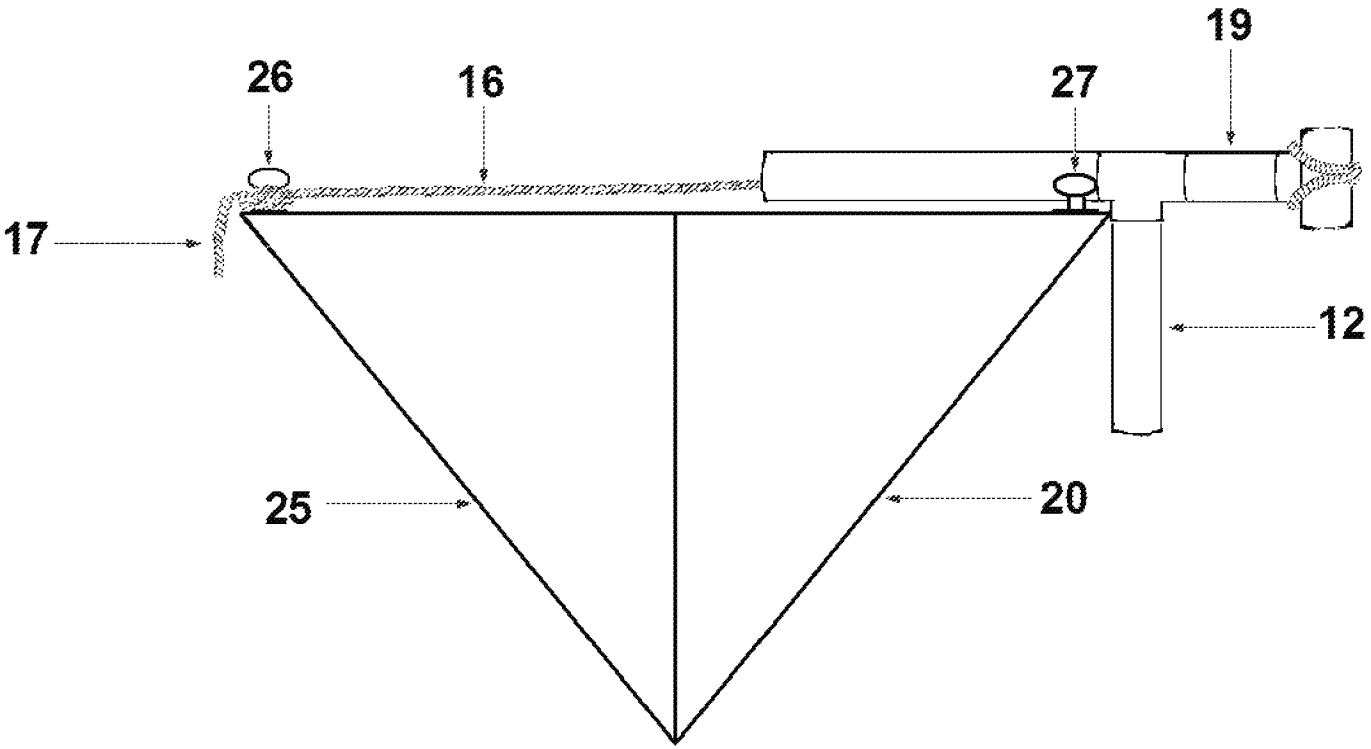
FIG. 11 is an elevation view of the boat mooring standoff during installation depicting the boat mooring standoff placed on the first side of the boat near the first bow mooring cleat with the third straight pipe positioned on the exterior of the first side of the boat and pointed down and the second end of the first dock mooring rope routed around the second bow mooring cleat located on the second side of the boat opposite the first bow mooring cleat.

Referring to FIG. 11, the boat mooring standoff 19 is positioned on the first side 20 near the first bow mooring cleat 27 with the third straight pipe 12 on the exterior of the first side 20 and pointed down. The second end 17 of the first dock mooring rope 16 is secured to the second bow mooring cleat 26 located on the second side 25 opposite the first bow mooring cleat 27.

Figure 12:
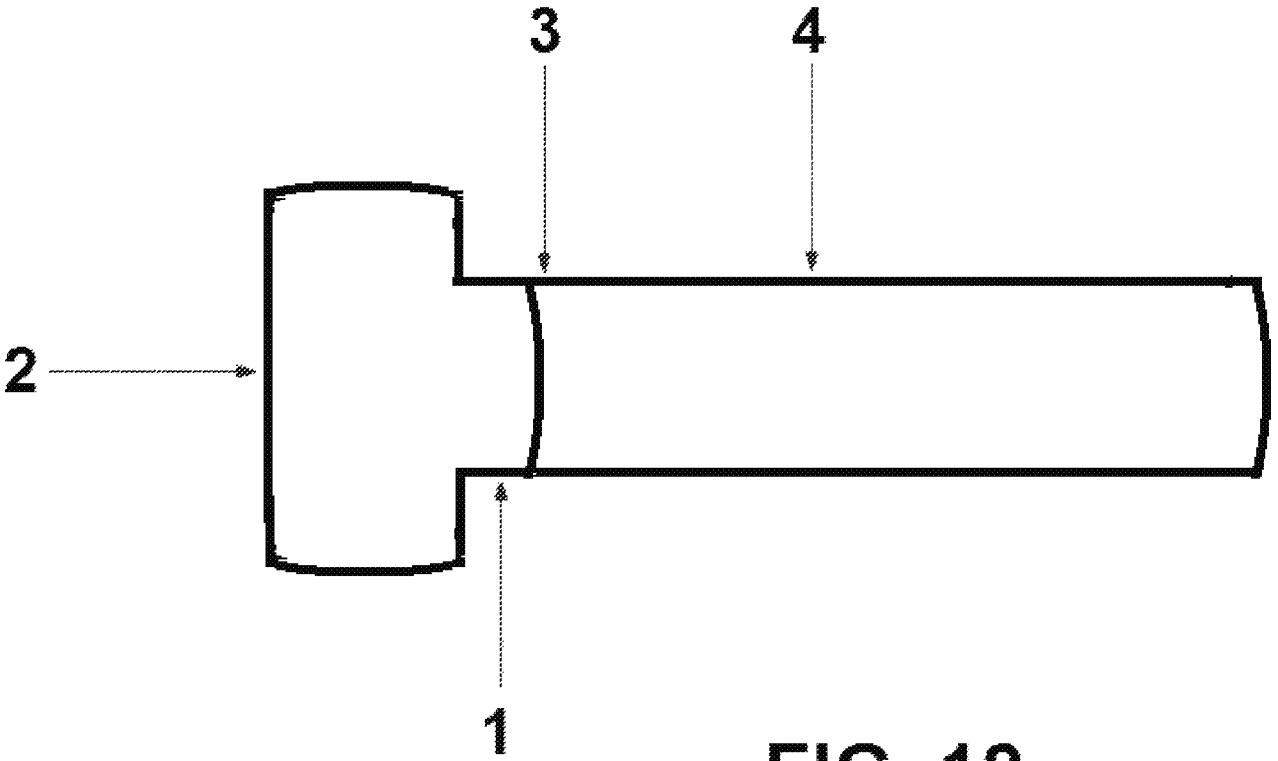
FIG. 12 is an elevation view of the boat mooring standoff during assembly depicting the main branch outlet of the first straight tee connected to the first end of the first straight pipe.

Referring to FIG. 12, the main branch outlet 1 of the first straight tee 2 is connected to the first end 3 of the first straight pipe 4.

Figure 13:
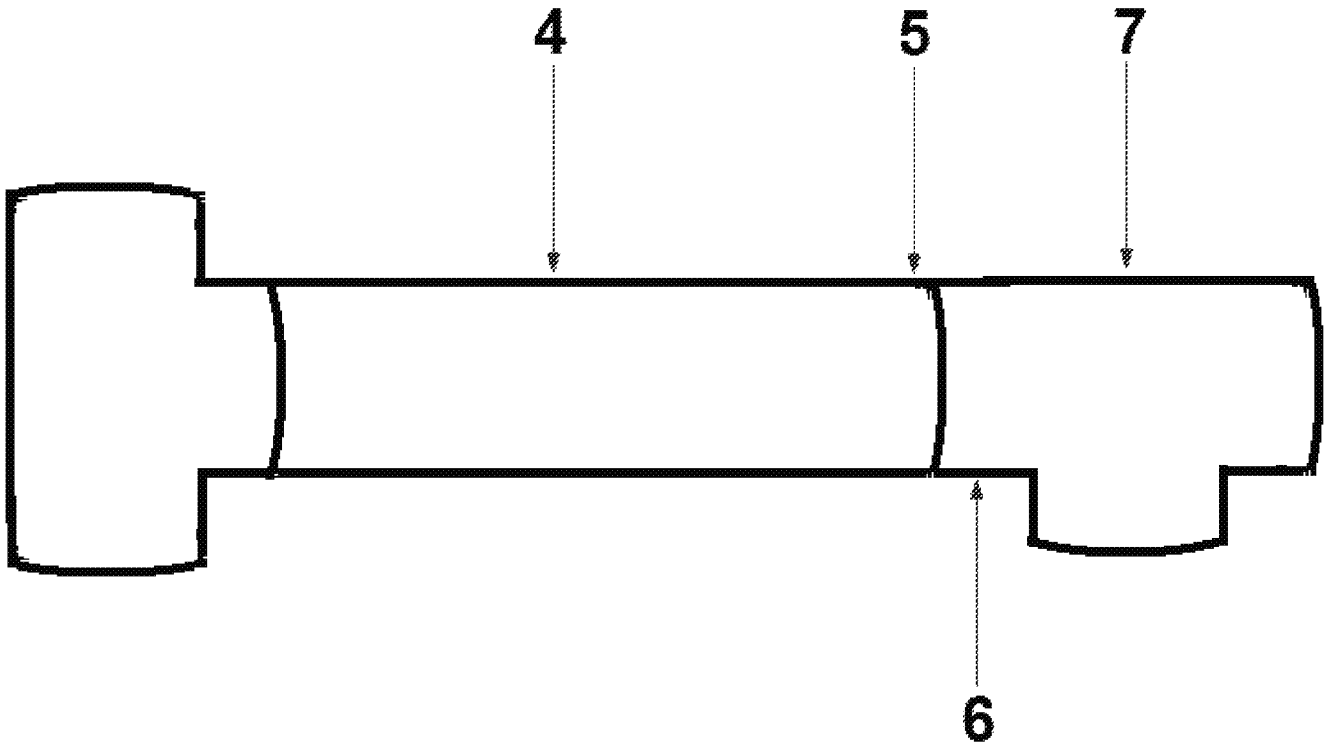
FIG. 13 is an elevation view of the boat mooring standoff during assembly depicting the second end of the first straight pipe connected to the first in line outlet of the second straight tee.

Referring to FIG. 13, the second end 5 of the first straight pipe 4 is connected to the first in line outlet 6 of the second straight tee 7.

Figure 14:
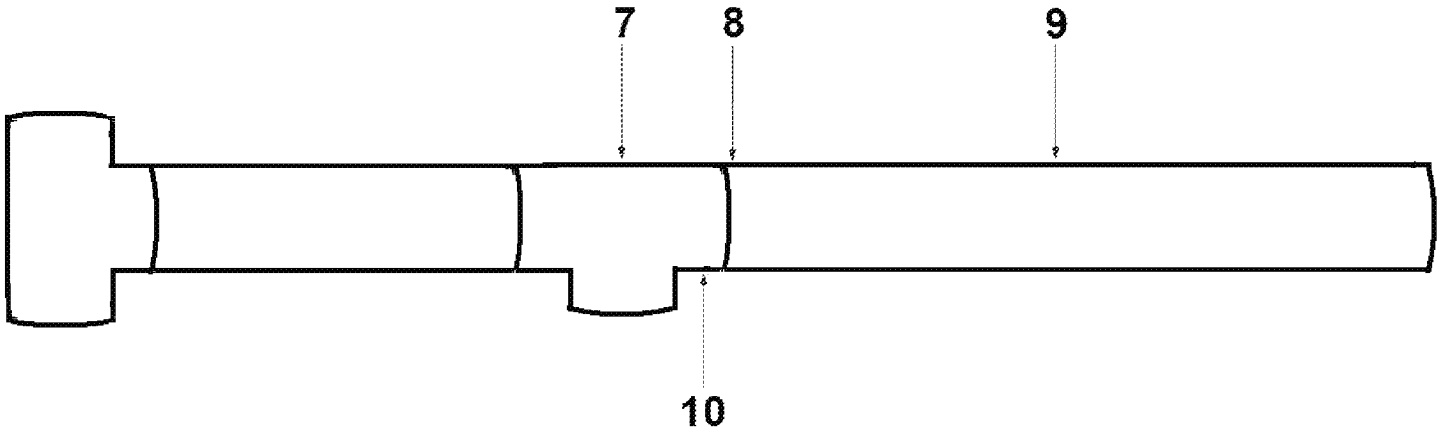
FIG. 14 is an elevation view of the boat mooring standoff during assembly depicting the first end of the second straight pipe connected to the second in line outlet of the second straight tee.

Referring to FIG. 14, the first end 8 of the second straight pipe 9 is connected to the second in line outlet 10 of the second straight tee 7.

Figure 15:
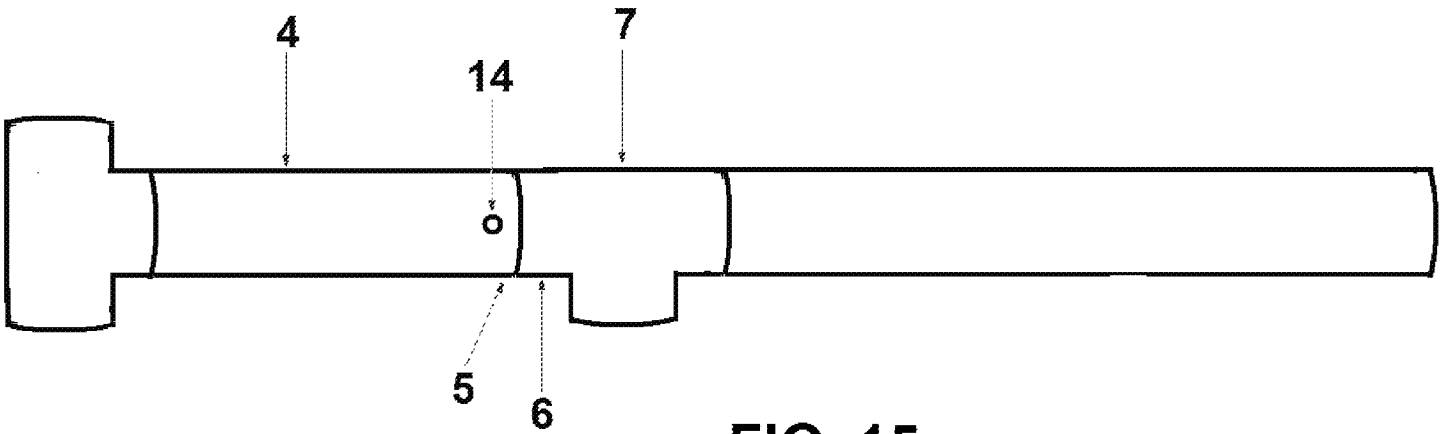
FIG. 15 is an elevation view of the boat mooring standoff during assembly depicting a hole drilled on the center line of the first straight pipe near the second end of the first straight pipe and near the first in line outlet of the second straight tee.

Referring to FIG. 15, a hole 14 is drilled on the center line of the first straight pipe 4 near the second end 5 of the first straight pipe 4 and near the first in line outlet 6 of the second straight tee 7.

Figure 16:
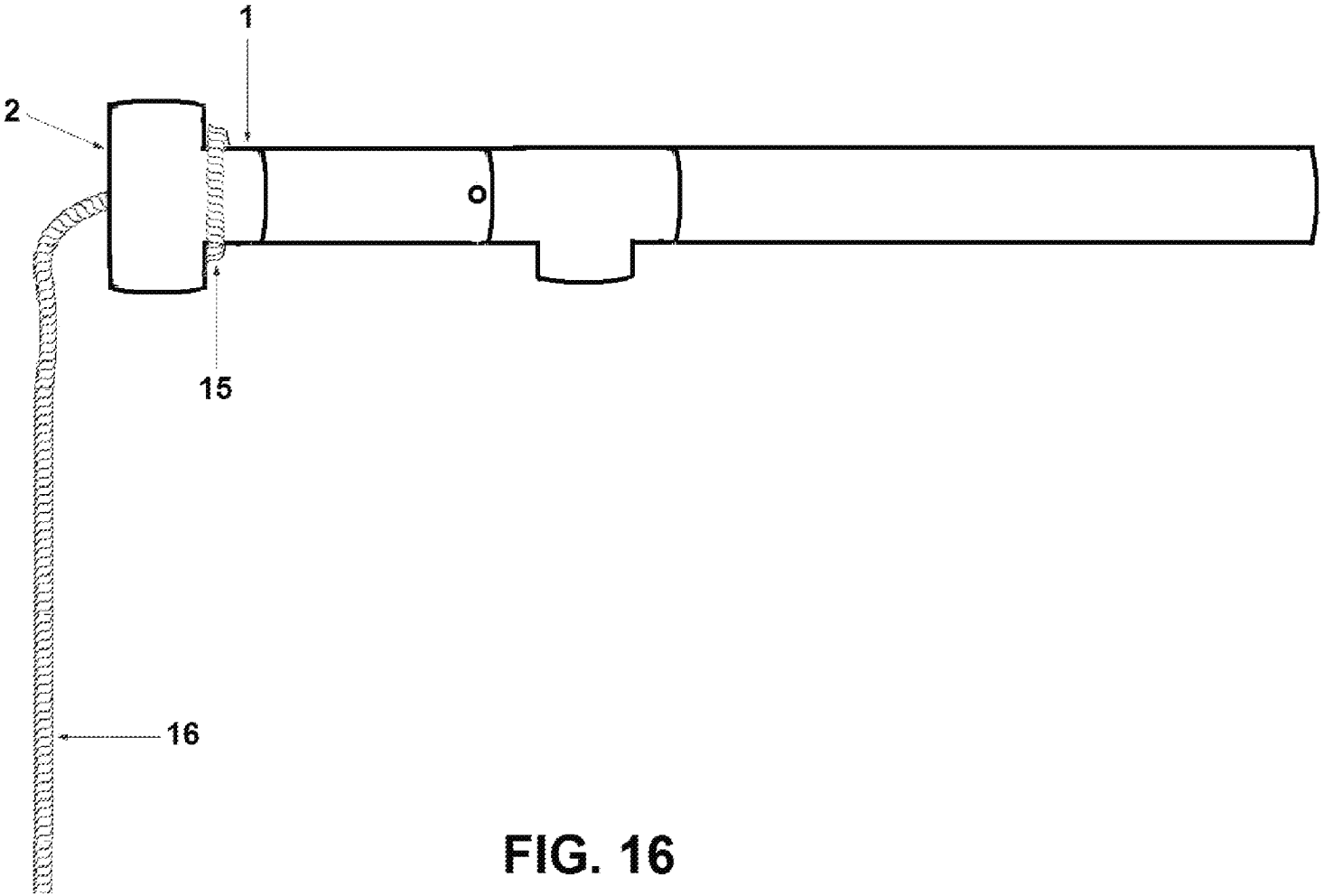
FIG. 16 is an elevation view of the boat mooring standoff during assembly depicting the looped first end of the first dock mooring rope placed over the main branch outlet of the first straight tee.

Referring to FIG. 16, the looped first end 15 of the first dock mooring rope 16 is placed around the main branch outlet 1 of the first straight tee 2.

Figure 17:
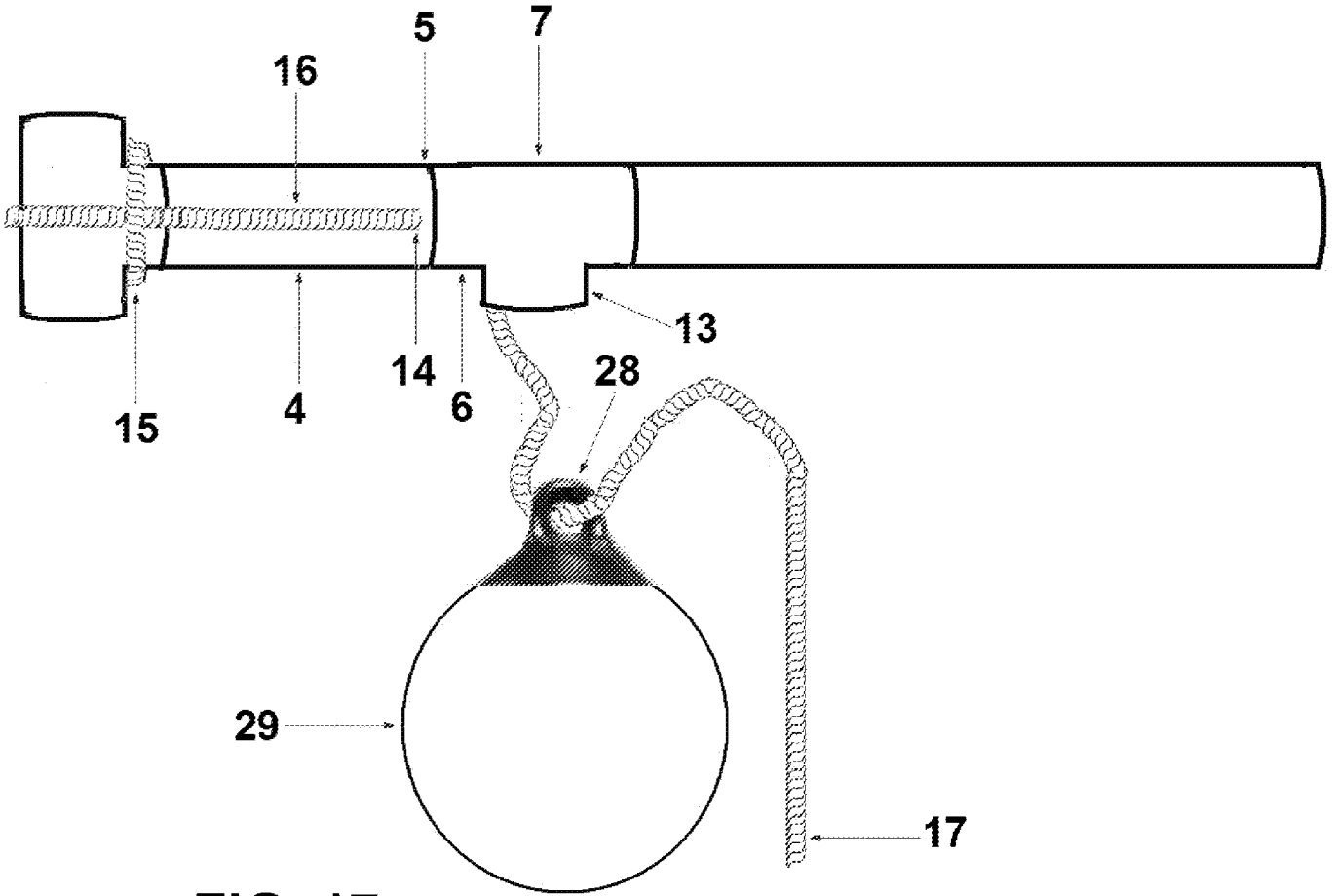
FIG. 17 is an elevation view of the boat mooring standoff during assembly depicting the second end of the first dock mooring rope routed under the looped first end of the first dock mooring rope and through the hole on the center line of the first straight pipe and through the second end of the first straight pipe and through the first in line outlet of the second straight tee and out of the main branch outlet of the second straight tee and through the eye of the mooring buoy.

Referring to FIG. 17, the second end 17 of the first dock mooring rope 16 is routed under the looped first end 15 of the first dock mooring rope 16 and through hole 14 on the center line of the first straight pipe 4 and through the second end 5 of the first straight pipe 4 and through the first in line outlet 6 of the second straight tee 7 and out of the main branch outlet 13 of the second straight tee 7 and through the eye 28 of the mooring buoy 29.

Figure 18:
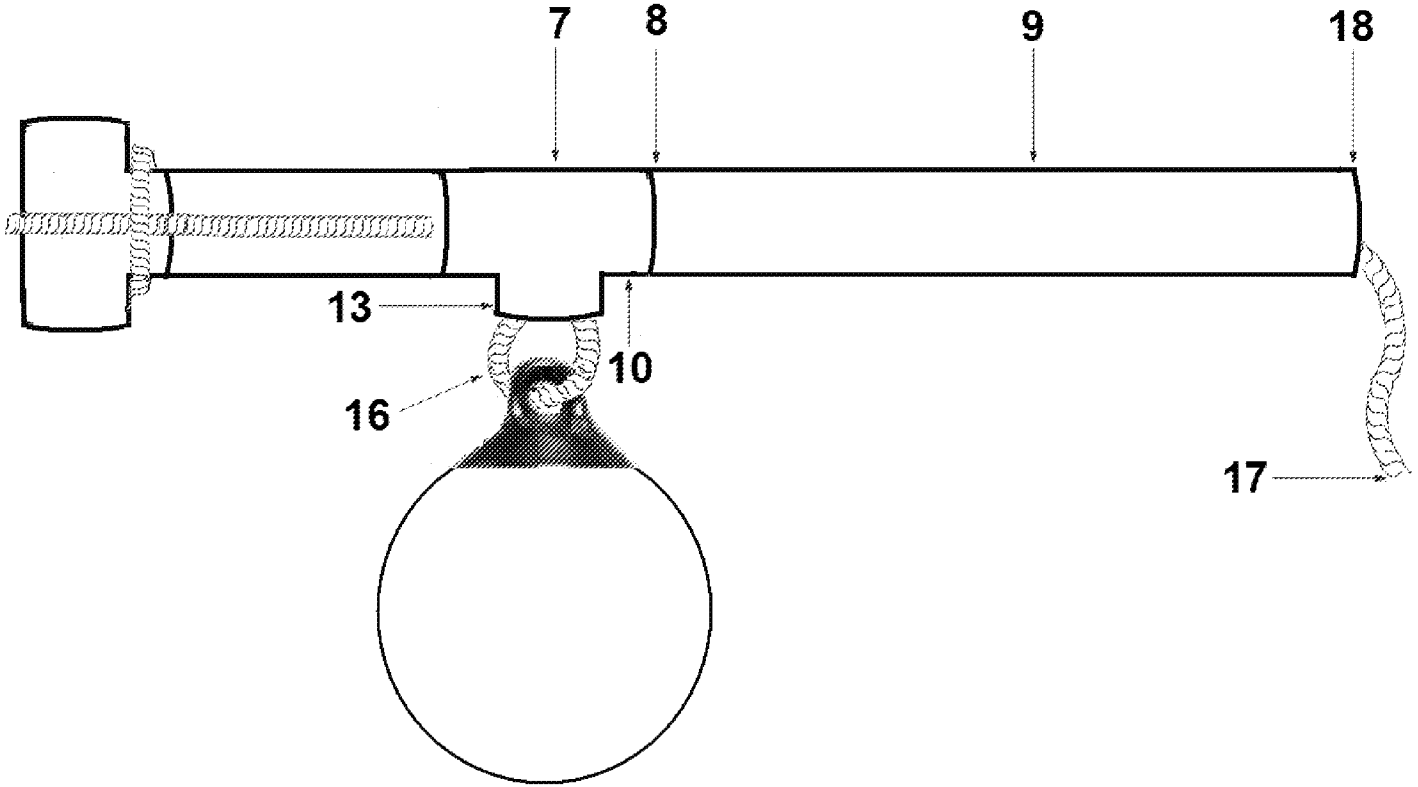
FIG. 18 is an elevation view of the boat mooring standoff during assembly depicting the second end of the first dock mooring rope routed through the main branch outlet of the second straight tee and through the second in line outlet of the second straight tee and through the first end of the second straight pipe and through the second straight pipe and out of the second end of the second straight pipe.

Referring to FIG. 18, the second end 17 of the first dock mooring rope 16 extends through the main branch outlet 13 of the second straight tee 7 and through the second in line outlet 10 of the second straight tee 7 and through the first end 8 of the second straight pipe 9 and through the second straight pipe 9 and out of the second end 18 of the second straight pipe 9.

Figure 19:
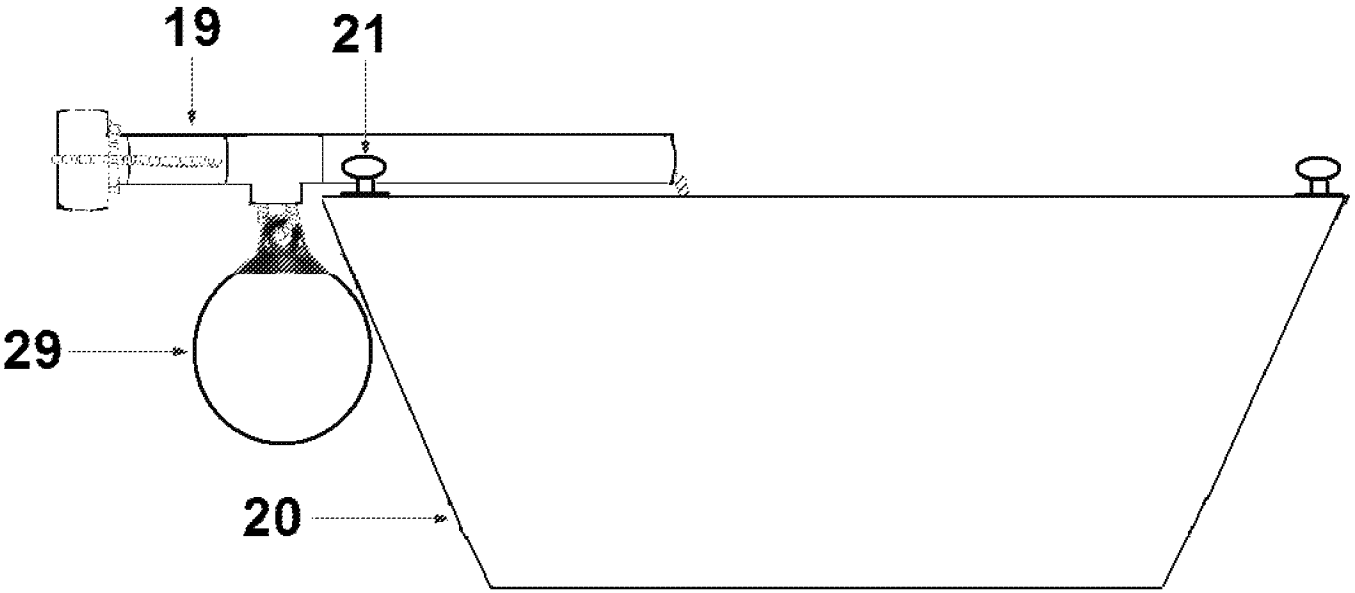
FIG. 19 is an elevation view of the boat mooring standoff during installation depicting the boat mooring standoff placed on the first side of the boat near the first stern mooring cleat with the mooring buoy positioned on the exterior of the first side of the boat and pointed down

Referring to FIG. 19, the boat mooring standoff 19 is positioned on the first side 20 near the first stern mooring cleat 21 with the mooring buoy 29 on the exterior of the first side 20 and pointed down.

Figure 20:
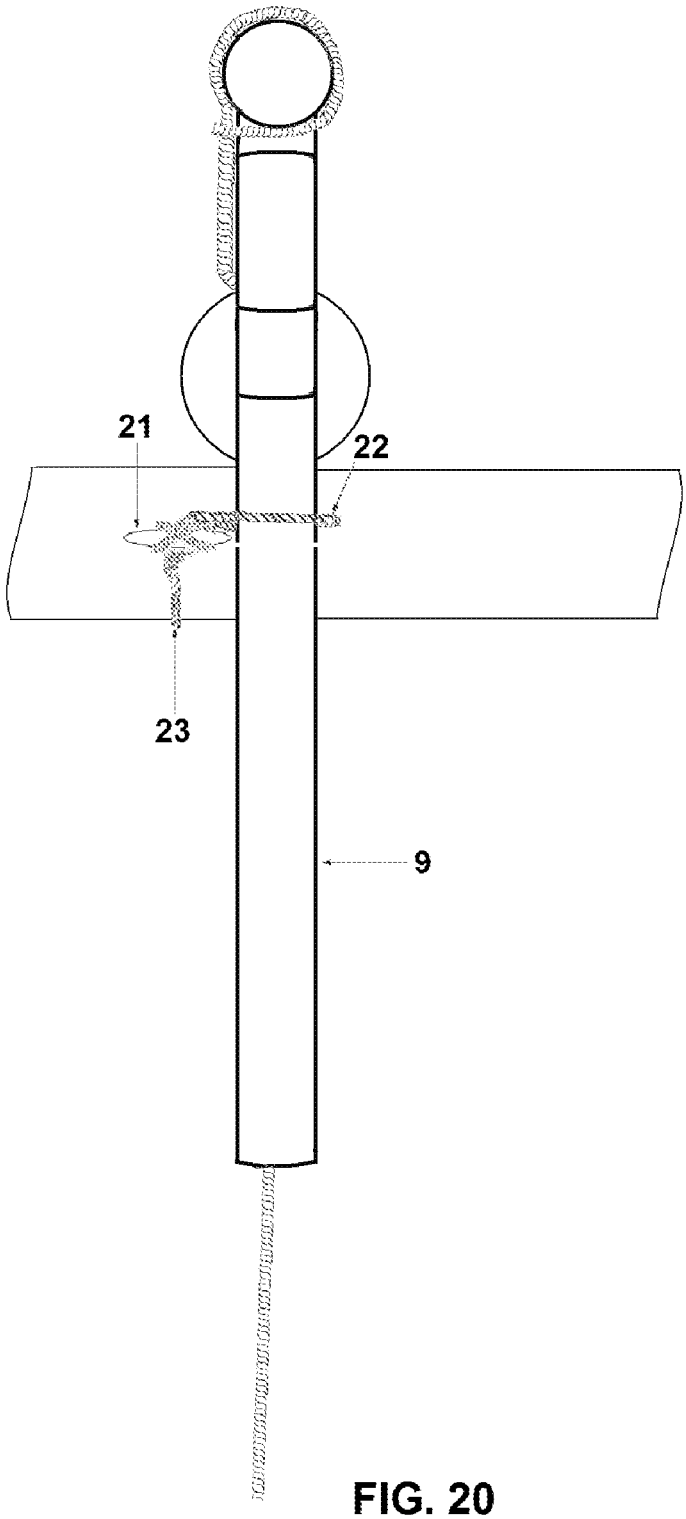
FIG. 20 is a plan view of the boat mooring standoff during installation depicting the looped first end of the second dock mooring rope placed over the second straight pipe and attached to the first stern mooring cleat.

Referring to FIG. 20, the looped first end 22 of the second dock mooring rope 23 is positioned around the second straight pipe 9 and secured to the first stern mooring cleat 21.

Figure 21:
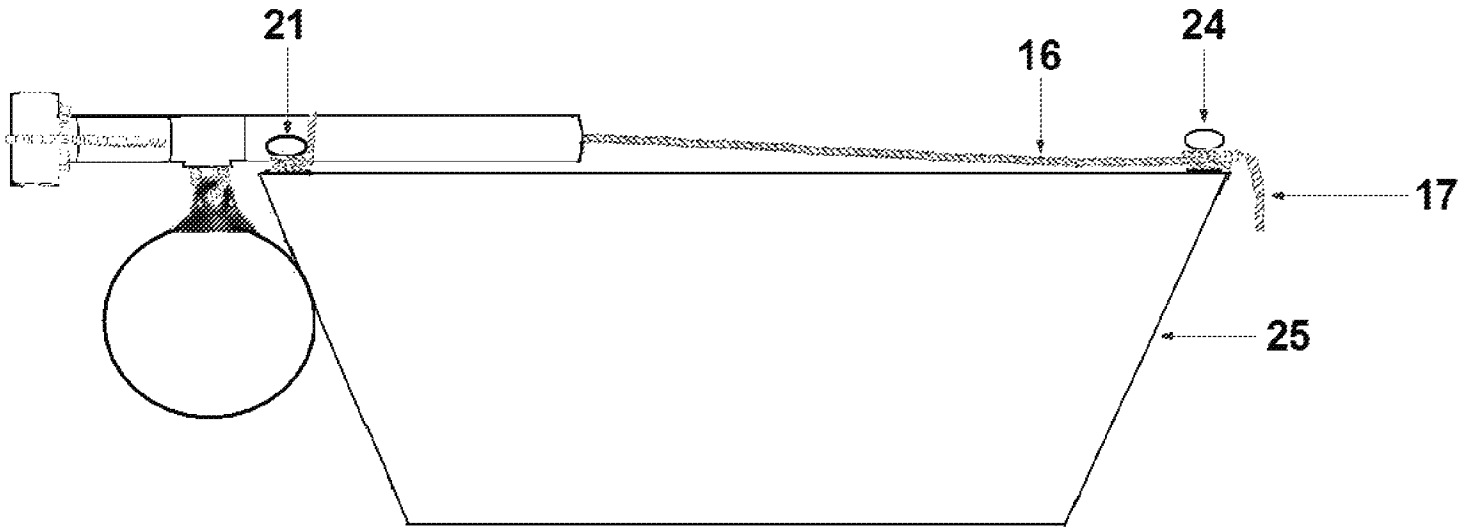
FIG. 21 is an elevation view of the boat mooring standoff during installation depicting the second end of the first dock mooring rope routed around the second stern mooring cleat located on the second side of the boat opposite the first stern mooring cleat.

Referring to FIG. 21, the second end 17 of the first dock mooring rope 16 is secured to the second stern mooring cleat 24 located on the second side 25 opposite the first stern mooring cleat 21.

Figure 22:
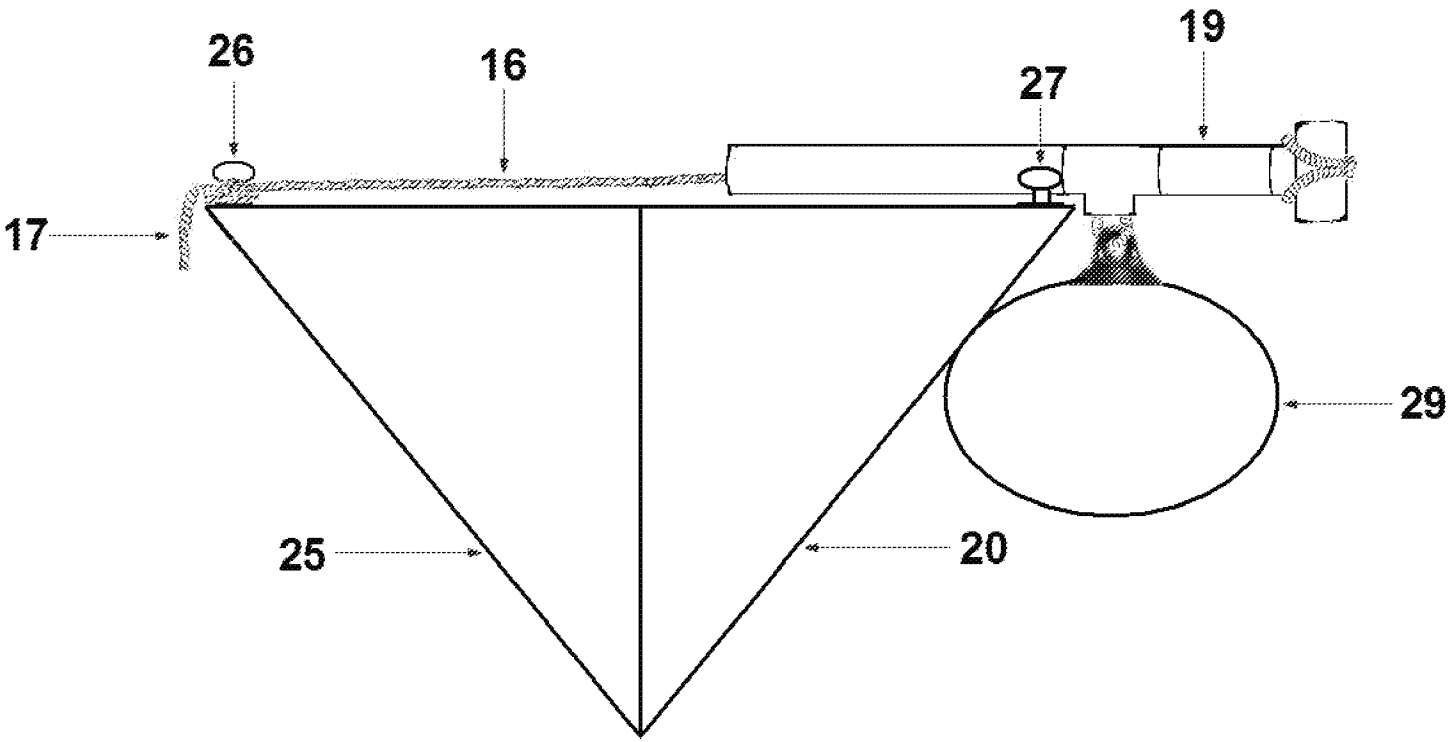
FIG. 22 is an elevation view of the boat mooring standoff during installation depicting the boat mooring standoff placed on the first side of the boat near the first bow mooring cleat with the mooring buoy positioned on the exterior of the first side of the boat and pointed down and the second end of the first dock mooring rope routed around the second bow mooring cleat located on the second side of the boat opposite the first bow mooring cleat.

Referring to FIG. 22, the boat mooring standoff 19 is positioned on the first side 20 with mooring buoy 29 on the exterior of the first side 20 and pointed down. The second end 17 of the first dock mooring rope 16 is secured to the second bow mooring cleat 26 located on the second side 25 opposite the first bow mooring cleat 27.

Figure 23:
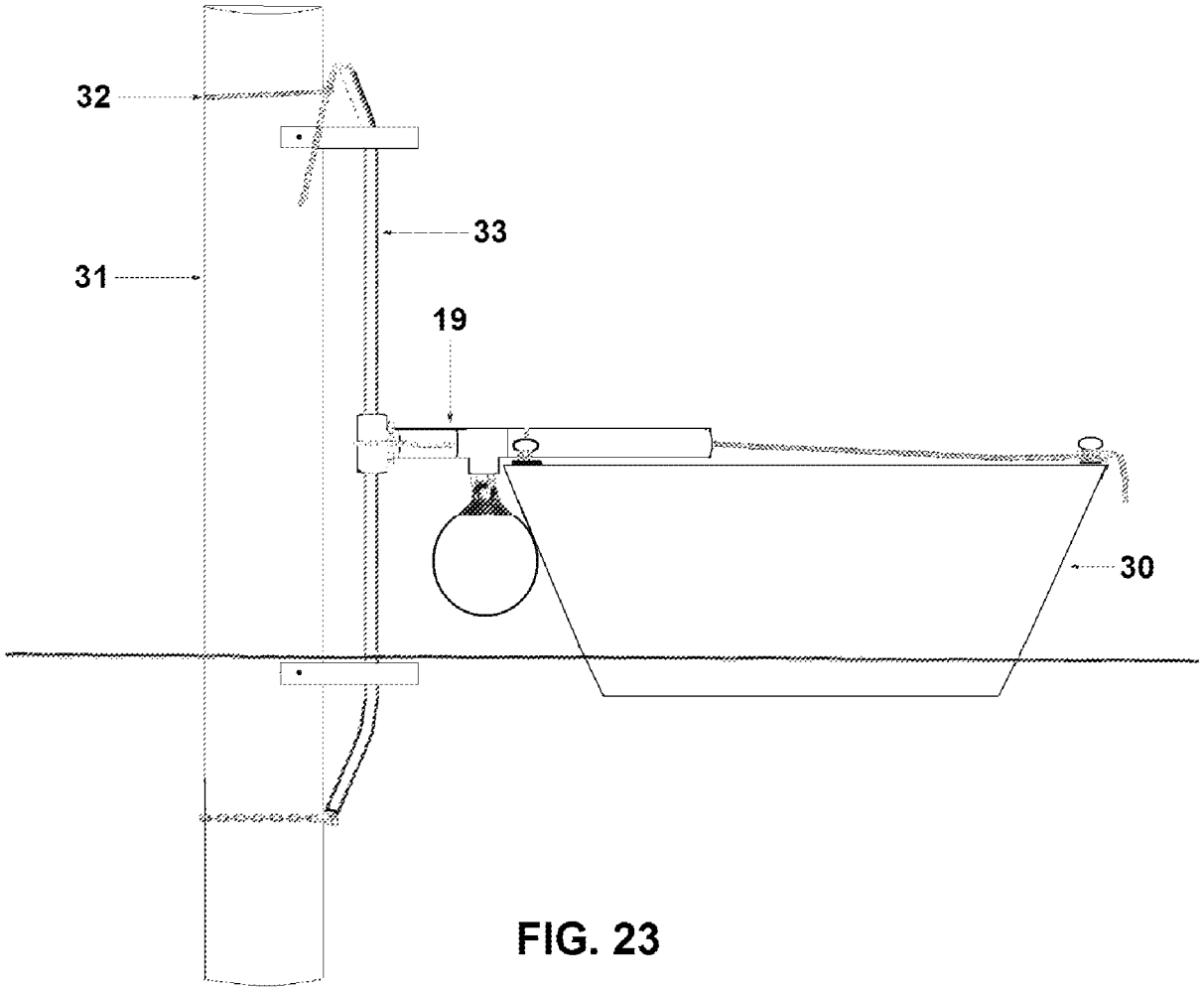
FIG. 23 is an elevation view of the boat mooring standoff during use depicting the boat mooring standoff mounted on a boat which is moored to a piling using the boat mooring standoff attached to a rope encased in a PVC pipe and attached vertically to the piling.

FIG. 23 shows boat 30 moored to piling 31 using the boat mooring standoff 19 which is attached to rope 32 encased in PVC pipe 33 and attached vertically to piling 31.

I claim:

1. A boat mooring standoff mounted to a boat instead of a dock used to moor a boat to a dock, pier, or piling by means of:

a first straight tee with the two in line outlets of the tee aligned vertically to compensate for vertical movement of the boat caused by large waves or tidal changes; and to provide flexibility to the boat mooring standoff because the tee moves freely and is not rigidly attached to the dock, pier, or piling; and to facilitate attachment of the first end of a dock mooring rope to the boat mooring standoff;

a first straight pipe with the first end connected to the main branch outlet of the first straight tee;

a hole in the side of the first straight pipe to provide a means to route the dock mooring rope from the first straight tee to the boat mooring cleat located on the opposite side of the boat from the boat mooring standoff;

a second straight tee connected to the second end of the first straight pipe to provide a means to attach a third straight pipe vertically to the boat mooring standoff;

a second straight pipe with the first end connected to the second in line outlet of the second straight tee to provide a means to route the dock mooring rope to the boat mooring cleat located on the second side of the boat opposite the first side of the boat where the boat mooring standoff is located;

a third straight pipe with the first end connected to the main branch outlet of the second straight tee which is pulled against the exterior side of the boat by the dock mooring rope as the dock mooring rope is tightened to the boat mooring cleat on the opposite side of the boat from the boat mooring standoff;

a dock mooring rope with the first end attached to the first straight tee and routed through a hole in the side of the first straight pipe and through the interior channel of the standoff assembly and attached to the boat mooring cleat located on the opposite side of the boat from the boat mooring standoff to pull the third straight pipe tightly against the exterior side of the boat; and to provide flexibility to the boat mooring standoff.

2. The device of claim 1, wherein the third straight pipe is replaced with a mooring buoy which is attached to the main branch outlet of the second straight tee using the first dock mooring rope.

* * * * *